US006142770A

United States Patent [19]

Saito

[11] Patent Number: 6,142,770

[45] Date of Patent: Nov. 7, 2000

[54] RUBBER COMPONENT FOR FIRE-LIGHTING DEVICE

[75] Inventor: Masaki Saito, Shizuoka-ken, Japan

[73] Assignee: Tokai Corporation, Tokyo, Japan

[21] Appl. No.: 09/201,975

[22] Filed: Dec. 1, 1998

[30] Foreign Application Priority Data

Dec. 3, 1997 [JP] Japan ..... 9-332880

[51] Int. Cl.[7] ..... F23D 14/28

[52] U.S. Cl. ..... 431/344; 428/462

[58] Field of Search ..... 431/344; 428/462

[56] References Cited

U.S. PATENT DOCUMENTS 5,615,655 4/1997 Shimizu ..... 123/419
6,036,478 3/2000 Inada ..... 431/344

*Primary Examiner*—Bernard Lipman
*Attorney, Agent, or Firm*—BakerBotts, L.L.P.

[57] ABSTRACT

A rubber component for a fire-lighting device to be disposed in a fuel supply passage between a fuel tank and a jetting nozzle for jetting fuel gas, where it is contacted by the fuel gas, is composed of a rubber material not blended with dioctyl phthalate or other plasticizer, thereby preventing obstruction of the fuel supply owing to clogging of the jetting nozzle and the like by DOP or other plasticizer eluted from the rubber component situated in the fuel gas supply passage.

2 Claims, 1 Drawing Sheet

RUBBER COMPONENT FOR FIRE-LIGHTING DEVICE

BACKGROUND OF THE INVENTION

1. Field of the Invention

This invention relates to a rubber component for a gas cigarette lighter, multi-purpose lighter or other fire-lighting device that vaporizes fuel gas stored in a fuel tank and burns the vaporized gas as it is jetted from a jetting nozzle, particularly to such a rubber component disposed in the fuel supply passage between the fuel tank and the jetting nozzle where it is in contact with the fuel gas.

2. Description of the Related Art

In a gas cigarette lighter, multi-purpose lighter or other such fire-lighting device, particularly in an internal combustion (premixed combustion system) fire-lighting device that effects ignition and burning after premixing air with the fuel gas jetted from the jetting nozzle, the jetting port of the jetting nozzle is made very small (diameter: 50–100 $\mu$m) in order to jet gas at a high flow rate. Since the jetting port is therefore easily clogged by foreign matter, problems such as lighting (ignition) failure tend to occur because of insufficient gas jetting.

For overcoming this drawback, Japanese Utility Model Publication 5(1993)-18609 teaches a technique of installing a metal mesh, filter or the like upstream of the jetting nozzle or at the primary air intake so as to catch dust or other foreign matter before it can adhere to and clog the jetting nozzle.

The installation of such a metal mesh or filter does not, however, completely prevent the problem of lighting failure owing to clogging of the jetting nozzle.

To determine the specific reason for this, a fire-lighting device that experienced nozzle clogging was disassembled and the foreign matter adhering to the jetting nozzle was analyzed. The analysis revealed the presence of dioctyl phthalate (DOP). DOP is a highly viscous substance commonly blended with rubber materials as a plasticizer and is generally contained in the O-rings, valve rubber and other rubber seal members used in a fire-lighting device.

When such rubber seal members come in contact with the fuel gas, DOP contained therein is eluted into the gas. Tests showed that when the fuel gas is jetted from the jetting nozzle to be burned, the gas pressure drives the eluted matter up to the jetting nozzle, where it adheres to and clogs the nozzle portion. Since the eluted DOP is in the form of a viscous liquid, the gas pressure can force some of it even through a metal mesh, filter or the like installed in the fuel gas passage. It can therefore reach the region of the jetting nozzle, where it adheres strongly owing to its high viscosity. The adhering DOP is not blown entirely away by the jetted gas but accumulates as an oily mass to obstruct jetting of the gas. It also catches ambient dust and foreign particles that further clog the jetting nozzle. As such, it is a cause of lighting failure.

This plasticizer (DOP) causes problems not only in the internal combustion type fire-lighting device. Also in the ordinary fire-lighting device that does not premix primary air, it similarly obstructs gas supply and causes lighting failure by clogging the flow splitter for improving lighting performance. In any type of fire-lighting device, the plasticizer is liable to make the gas supply rate unstable by finding its way into the flow rate regulation filter.

In light of the foregoing problems, this invention aims to provide a rubber component for a fire-lighting device that prevents obstruction of fuel supply owing to clogging caused by elution of DOP or other such plasticizer from a rubber component disposed in the fuel gas supply passage.

SUMMARY OF THE INVENTION

For overcoming the foregoing problems, this invention provides a rubber component for a fire-lighting device to be disposed in a fuel supply passage between a fuel tank and a jetting nozzle for jetting fuel gas where it is contacted by the fuel gas, the rubber component being composed of a rubber material not blended with dioctyl phthalate or other plasticizer.

The rubber material is preferably one obtained by blending liquid NBR polymer with NBR polymer.

Since the rubber component according to the invention is composed of rubber material that does not contain DOP or other plasticizer, no DOP or other such viscous plasticizer is eluted therefrom when the fuel gas contacts the rubber component. Clogging of the jetting nozzle, flow splitter or the like is therefore prevented to ensure proper combustion with no occurrence of lighting failure owing to fuel supply obstruction.

The rubber material can, for example, be one obtained by blending liquid NBR polymer with NBR polymer. Owing to the plasticizing effect of the liquid polymer, such a rubber material, even without inclusion of DOP or other plasticizer, exhibits good formability and enables securement of a rubber component with the required elasticity and other properties. Moreover, the rubber component can be produced with no appreciable cost increase.

DESCRIPTION OF THE PREFERRED EMBODIMENT

Figure 1:
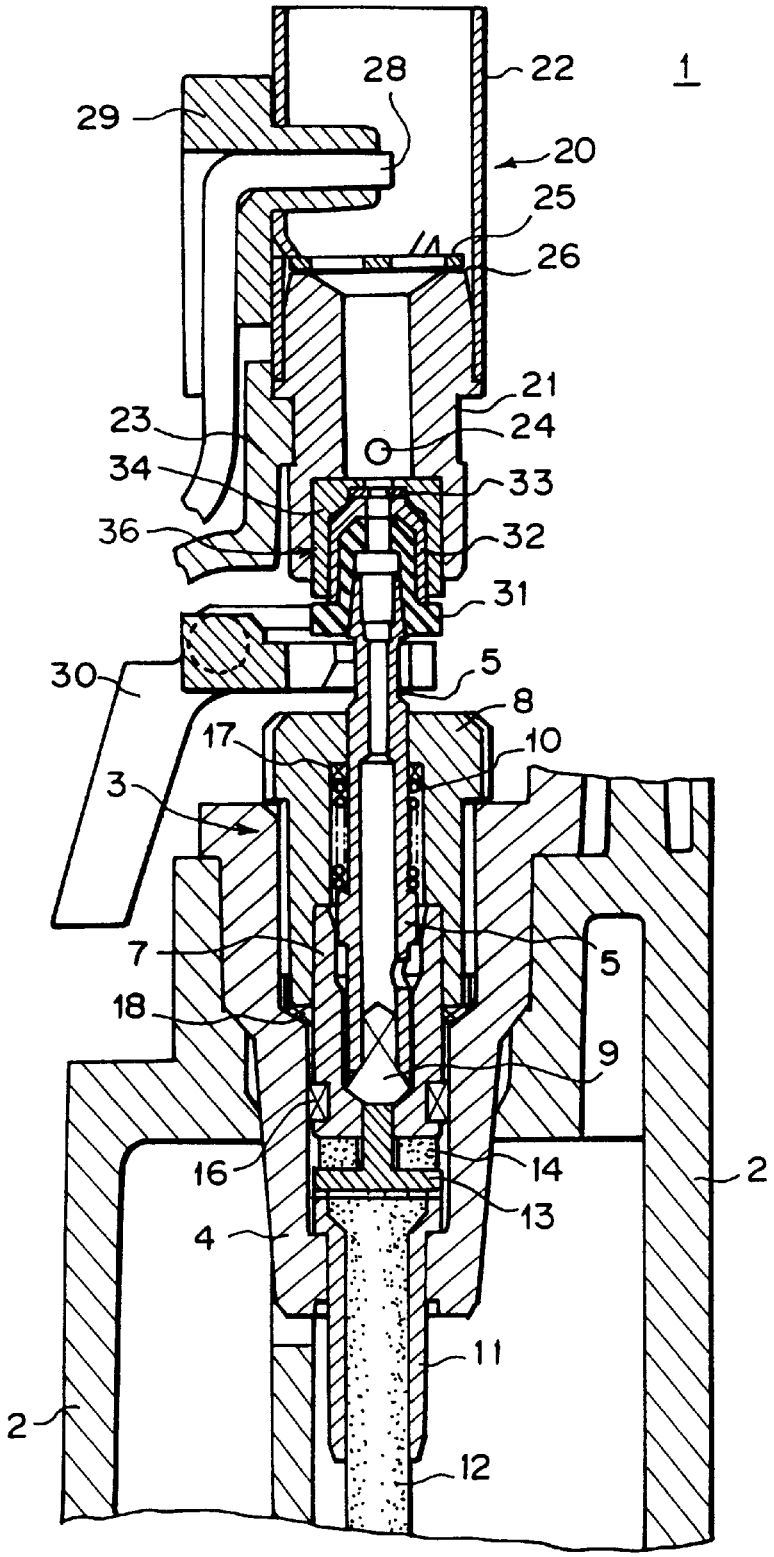
FIG. 1 is a sectional view of the essential portion of a fire-lighting device equipped with rubber components that are each an embodiment of the invention.

An embodiment of the invention will now be explained in detail with reference to the drawing.

FIG. 1 shows the sectional structure of the essential portion of a gas cigarette lighter as an example of a fire-lighting device utilizing rubber components according to the invention.

This gas cigarette lighter, designated by reference numeral 1, is of conventional structure. It has a main tank body 2 for storing fuel gas at its lower portion. The main tank body 2 is formed of synthetic resin and holds a high-pressure fuel gas such as butane gas. A fuel supply device 3 including a joint nozzle 5 for jetting the fuel gas is mounted on top of the main tank body 2 as accommodated in a valve housing 4. A burner 21 and a combustion cylinder 20 defined by a combustion tube 22 are installed above the joint nozzle 5 for burning the fuel gas jetted from the joint nozzle 5. As its gas burning system, the combustion cylinder 20 utilizes the primary air mixed internal combustion system involving intake and mixing of primary air.

A piezoelectric unit (not shown) is disposed at the side of the fuel supply device 3. An operation member (not shown) is provided on top of the piezoelectric unit for operating the joint nozzle 5 to jet fuel gas and operate the piezoelectric unit to ignite the jetted fuel gas. The combustion cylinder 20 is mounted on the main tank body 2 as retained by an internal housing 23.

The fuel supply device 3 jets gas from its tip when a passage is opened by upward movement of the joint nozzle 5. An L-shaped operation lever 30 having one end portion engaged with the joint nozzle 5 is rotatably supported at a pivot point midway thereof. An operation section at the other end thereof is rotatably operated in response to operation of the aforesaid operation member to start and stop jetting of gas by the joint nozzle 5.

A joint rubber 31 and a jetting nozzle 36 are interposed between the tip portion of joint nozzle 5 and the burner 21. Each of these members is provided with a center hole for forming a gas passage.

The tip portion of the joint nozzle 5 is inserted into the bottom of the joint rubber 31 and can be advanced and retracted. The jetting nozzle 36 is inserted into the bottom of the burner 21.

The jetting nozzle 36 consists of a plate presser 32, a nozzle plate 33 and a plate holder 34. The nozzle plate 33 is fixed as pinched between the plate presser 32 and the plate holder 34 and the upper portion of the joint rubber 31 is fitted into the internal space of the plate presser 32. The nozzle plate 33 is formed with a small hole of prescribed diameter (e.g., 50 $\mu$m) to enable gas to be jetted into the burner 21 at high velocity.

The valve housing 4 is fitted into the main tank body 2 made of synthetic resin. A valve main body 7 is inserted into a mounting hole formed to pass through the interior of the valve housing 4 and a fastening member 8 is screwed therein to press onto the valve main body 7. The thin, tube-like joint nozzle 5 is disposed inside the valve main body 7 and the fastening member 8 to be free to slide in its axial direction.

The joint nozzle 5 has an internal passage whose one end (upper end) projects from the center of the fastening member 8 as a jetting port, whose other (lower) end is closed by a valve body 9 inserted therein, and whose middle portion communicates with the surrounding portion through an opening. A hole formed at the center of the lower end portion of the valve main body 7 constitutes a valve seat for the valve body 9, whereby this center hole can be opened and closed. The joint nozzle 5 is urged in the seating direction by a valve spring 10 compressed between itself and the upper inner surface of the fastening member 8.

A draw-up wick 12 made of porous material is inserted into a wick holder 11 and fitted into the bottom of the valve housing 4. A flow rate regulation filter 14 is disposed at the upper end of the wick holder 11 as retained by a nail-like fastener 13.

An O-ring 16 is fitted between the outer periphery of the valve main body 7 and the inner surface of the valve housing 4 and an O-ring 17 (threaded O-ring) for establishing a gas seal is provided between the outer periphery of the joint nozzle 5 and the inner surface of the fastening member 8. The O-ring 17 is in contact with one end of the valve spring 10. An O-ring 18 (seal ring) is further fitted between the tip portion of the fastening member 8 and a step portion of the inner surface of the valve housing 4.

The combustion cylinder 20 consists of the burner 21 at the base and the combustion tube 22, which is fastened to and extends upward from the burner 21. The gas passage extends through the center region of the burner 21. A primary air hole 24 is formed in the side surface of the burner 21 at a point near the bottom thereof located above the plate holder 34 fitted therein.

A vortex plate 25 and a metal mesh member 26 are placed on the upper end portion of the burner 21. A discharge electrode 28 is held by an electrode holder 29 to pass through the side of the combustion tube 22 and face into the interior thereof.

When the operation lever 30 is rotated, the joint nozzle 5 is raised against the force of the valve spring 10 to separate the valve body 9 from the valve seat of the valve main body 7. Fuel gas rising from the tank through a draw-up wick 12 passes around the outer periphery of the nail-like fastener 13 and then from the peripheral portion of the flow rate regulation filter 14 toward the center thereof. The flow rate-regulated gas passes from the interior of the valve main body 7 through the portion surrounding the joint nozzle 5 into the internal passage of the joint nozzle 5 to be jetted from the tip thereof. The fuel gas jetted from the joint nozzle 5 passes through the small hole of the nozzle plate 33 of the jetting nozzle 36 and into the burner 21 at high velocity. The low pressure produced in proportion to the flow velocity and quantity of the inflowing gas sucks in primary air through the primary air hole 24 in the side of the burner 21. The inflowing gas and the primary air are mixed by passage through the metal mesh member 26 and the vortex plate 25 and the mixed gas rises into the combustion tube 22. The mixed gas then burns upon being ignited by spark discharge from the discharge electrode 28.

The valve body 9, O-rings 16–18 and the joint rubber 31 of the fuel supply device 3 are rubber components (rubber seal members made of rubber material) that make contact with the fuel gas. These rubber components are formed of rubber material that does not contain plasticizer. For example, they are formed of a rubber material obtained by blending liquid NBR polymer with NBR polymer. Owing to the plasticizing effect of the liquid polymer, the rubber material, even without inclusion of DOP or other plasticizer, exhibits good formability and enables securement of rubber components with the required elasticity and other properties. Since elution of viscous substance is therefore not caused by contact of the rubber components with the fuel, clogging of the small hole of the nozzle plate 33 of the jetting nozzle 36 and other portions of the fuel supply passage can be prevented.

What is claimed is:

1. A rubber component for a fire-lighting device to be disposed in a fuel supply passage between a fuel tank and a jetting nozzle for jetting fuel gas where it is contacted by the fuel gas, the rubber component comprising a rubber material which is essentially free of plasticizer.

2. A rubber component for a fire-lighting device according to claim 1, characterized in that the rubber material is one obtained by blending liquid NBR polymer with NBR polymer.

* * * * *